United States Patent [19]

Saeki et al.

[11] Patent Number: 4,460,034

[45] Date of Patent: Jul. 17, 1984

[54] MOLD FOR CONTINUOUS CASTING

[76] Inventors: Tsuyoshi Saeki, No. 2200-24, Aza Ushirotani, Oaza Nakama, Nakama-shi, Fukuoka-ken; Katsuhiro Kawashima, No. 1-17-45, Okura, Yahata-Higashi-ku, Kitakyushu-shi, Fukuoka-ken; Mitsuo Murata, No. 6-28-8, Hinosato, Munakata-cho, Munakata-gun, Fukuoka-ken; Mituhiro Oota, No. 66-23, Izumi, Kimitsu-shi, Chiba-ken, all of Japan

[21] Appl. No.: 506,864

[22] Filed: Jun. 22, 1983

Related U.S. Application Data

[63] Continuation of Ser. No. 220,233, Dec. 23, 1980, abandoned.

[51] Int. Cl.[3] ..... B22D 11/04; B22D 11/10

[52] U.S. Cl. ..... 164/478; 164/416

[58] Field of Search ..... 164/478, 71.1, 511, 164/416, 260

[56] References Cited

FOREIGN PATENT DOCUMENTS

| | | | |
|---|---|---|---|
| 53-48929 | 5/1978 | Japan | 164/416 |
| 55-16703 | 2/1980 | Japan | 164/478 |
| 55-45558 | 3/1980 | Japan | 164/478 |

*Primary Examiner*—Kuang Y. Lin
*Assistant Examiner*—J. Reed Batten, Jr.
*Attorney, Agent, or Firm*—Cushman, Darby & Cushman

[57] ABSTRACT

A continuous casting mold having the wall thickness of each of parts corresponding to a point where molten steel begins to solidify during continuous casting is arranged to be locally thinner than other parts of the mold. High frequency oscillation is applied to the locally thinned parts to vibrate them to a sufficient amplitude to prevent the seizure of a cast steel piece from taking place due to the heat thereof for improvement in the surface quality thereof.

2 Claims, 23 Drawing Figures

MOLD FOR CONTINUOUS CASTING

This is a continuation of application Ser. No. 220,233, filed Dec. 23, 1980 and now abandoned.

BACKGROUND OF THE INVENTION

1. Field of the Invention

This invention relates to a continuous casting mold for metals and more particularly to an upward open type mold for vertical continuous casting of metals.

2. Description of the Prior Art

Continuous casting methods have recently come to be widely adopted particularly in the steel industry for mechanization of steel solidifying processes, improvement in the yield of the products and reduction in the cost of manufacture. However, there are various problems that still remain to be solved including, for example, improvement in the surface quality of cast pieces.

In casting, a steel piece in process tends to be seized by the mold due to heat. Then, there would be produced a crack when the seized part is pulled by pinch rolls from below. Then, the molten steel would spurt out through the crack to cause a serious accident. To prevent such a seizure, therefore, it has hitherto been practiced either to use a seizure preventing agent between the steel piece or to have the mold vibrated in addition to the application of the preventing agent.

However, in the case of vibrating the mold, the steel piece tends to have surface flaws which lowers the yield. The problem thus presented by the conventional method will be clearly understood from the following description thereof with reference to the accompanying drawings.

In accordance with the conventional continuous steel casting method, which is as illustrated in FIG. 1 of the accompanying drawings, molten steel 101 which has been obtained from a converter or the like is put into a ladle 2 and is poured into a tundish 4 through a nozzle 3. The poured molten steel 102 is allowed to flow through a dipping tube 5 down to a mold 6 which is cooled with water passing through a cooling box 21. The molten steel 70 within the mold 6 comes to be divested of its heat by the low temperature of the mold 6 and begins to solidify at a point 8 as shown in the drawing. Then, a solidified layer 71 begins to be formed there. The molten steel further descends while being pulled by supporting or pinch rolls 9 and other rolls 10. The temperature of the molten steel further lowers accordingly as the molten steel 71 further descends. The solid layer 71 thus increases until the fluid portion of the steel disappears and the whole of the steel solidifies into a steel piece. However, the solidified layer 71 sometimes comes to be seized by the mold 6 due to its heat at the point where the molten steel begins to solidify and thus becomes hardly separable from the mold 6. FIG. 2 of the accompanying drawings is an enlarged view of the upper part of the mold 6 and an area around it showing such a seizure and a trouble resulting therefrom. As mentioned in the foregoing, the molten steel 70 poured in from the dipping tube is divested of heat thereof when it comes into contact with the mold 6 at the point 8. The molten steel 70 then immediately begins to solidify. However, the solidifying layer thereof tends to have a seizure 75 on the surface of the mold. When the solidified steel in a seized condition is pulled from below by pinch rolls 9, if there is a thin part 76 in the solidifying layer 71, a crack 77 would be produced there. The molten steel 70 then would come to spurt out from the inside through the crack 77. The continuous casting operation under such a condition becomes no longer possible and the molten steel spatters around the facilities to cause a serious accident.

To prevent such an accident, either the possibility of having such a seizure 75 must be eliminated or the pinch rolls 9 must be stopped from pulling. However, the pulling action performed by the pinch rolls 9 is absolutely necessary for continuously having the molten steel which is poured in succession from above taken out from below in the form of a steel piece 12 in a continuous manner. The pinch rolls 9, therefore, cannot be stopped. Hence, in the conventional continuous casting method, the following two preventive measures have been taken:

(1) A third substance 14 is arranged to be formed on the surface of the solidifying layer 71 to prevent the solidifying layer 71 from coming into contact directly with the mold 6 as shown in FIG. 3.

(2) Vertical vibration 16 is imparted to the mold 6 as shown in FIG. 4 to prevent the solidifying layer 71 from having a sufficient length of time for causing a seizure on the mold 6.

Further details of these two seizure preventing measures are as follows.

In the first measure which is as shown in FIG. 3, fine powder 13 (hereinafter it will be called the powder) is scattered over the upper surface of the molten steel within the mold 6. The powder 13 flows through a gap between the molten steel 70 and the mold 6 and covers the surface of the molten steel 70 in the form of a coating 14 when the molten steel 70 comes to solidify. Then, the surface atoms of the solidifying layer 71 can be prevented from being bonded together with the surface atoms of the mold 6.

In the second measure which is as shown in FIG. 4, vertical vibration 16 is mechanically imparted to the mold 6. By this, there is produced a relative vertical movement between the solidifying layer 71 and the mold 6 to prevent a point of the mold 6 from being long in contact with one point of the solidifying layer 71. Assuming that a point on the surface of the mold 6 to which the vertical vibration is imparted is A, the point A is in contact with a point Ao of the solidifying layer 71 at one moment. Then, the point on the solidifying layer 71 contacting the point A moves upward and changes to points A1, A2, A3, . . . according as the mold 6 moves upward relative to the solidifying layer 71. Conversely, when the mold 6 moves downward relative to the solidifying layer 71, the point on the solidifying layer 71 contacting the point A on the mold 6 changes to points A1′, A2′, A3′, . . . . In other words, the contacting points of the mold 6 and the solidifying layer 71 are always varying. This arrangement thus does not allow the mold 6 and the solidifying layer 71 to be bonded together, so that seizure can be effectively prevented.

As described in the foregoing, the seizure between the mold 6 and the solidifying layer 71 due to heat has been prevented by the use of the powder 13 in combination with application of mechanical vibration 16 to the mold 6. Of these two measures, however, the application of mechanical vibration 16 to the mold 6 presents a problem that the vibration tends to produce surface flaws of the steel piece 12 and thus tends to lower the yield, because: With the vibration applied, there will be produced recesses 20 on the surface of the cast steel piece at regular intervals 26 in the longitudinal direction as shown in the photograph of FIG. 16. The intervals 26 of these recesses 20 are determined by the frequency of the mechanical vibration 16 and the drawing speed of the continuous casting operation. This unevenness is called an oscillation mark. The oscillation mark indicates that the solidifying skin is formed intermittently at periodic intervals coinciding with the frequency of the vertical mechanical vibration of the mold. The depth of the recess is determined jointly by the viscosity and the melting temperature of the powder used, the addition quantity of the powder, melting speed, cast steel piece drawing speed, mold vibrating frequency and amplitude of the vibration, etc. The formation of oscillation marks thus indicates that the surface of the cast piece is uneven. It is particularly a serious problem that the powder tends to be trapped within the cast steel piece at the recesses. Further, since there is a difference in the cooling condition between a protrudent part and a recessed part, this difference tends to cause cracks. FIG. 5 shows an example of having the powder trapped at a recessed part of a cast steel piece. A crack is sometimes produced from this point. Once a crack is produced, it is seldom healed by pressure exerted thereon during a subsequent rolling process and remains as a surface flaw of the product. Such cracks lower the yield of products to a great extent. Further, in the case of products where surface conditions are to be subjected to a severe inspection, even if the powder 13 remains simply captured on the surface without causing any crack, the whole surface of such a cast steel piece sometimes must be planed by fusing it to remove the layer containing the powder in such a state, because: With the powder remaining in such a state, there is a high degree of probability that a product thus obtained eventually comes to have a scratch or a stripe-like pattern which results therefrom to degrade the quality of the product. This, therefore, sometimes lowers the yield by as much as 2%.

SUMMARY OF THE INVENTION

It is therefore a general object of this invention to provide a continuous casting mold which eliminates the above stated shortcomings of the prior art with a novel arrangement in which: Each of the parts of the mold corresponding to a point where molten steel begins to solidify during continuous casting thereof is arranged to have the wall thickness locally thinned and thus to be thinner than other parts of the mold; and high frequency oscillation is applied to the locally thinned part of the mold to prevent the seizure of a cast steel piece due to the heat thereof for improvement in the surface quality of the cast steel piece thus obtained.

In accordance with the present invention, the seizure is prevented by making each part of the mold where the seizure most likely takes place thinner than other parts of the mold, the thinned part being located at a point where the molten steel begins to solidify and in the vicinity thereof, for example, a part within 300 mm from the upper end of the mold; and by applying high frequency oscillation to the thin part of the mold.

The above and further objects and features of the invention will become apparent from the following detailed description thereof taken in connection with the accompanying drawings.

BRIEF DESCRIPTION OF THE DRAWINGS

FIG. 6(*b*) is a sectional view of the mold shown in FIG. 6(*a*).

FIG. 10(*b*) is another graphic representation showing the relation of the vertical position of the same mold to the amplitude.

DETAILED DESCRIPTION OF THE PREFERRED EMBODIMENTS

Figure 1:
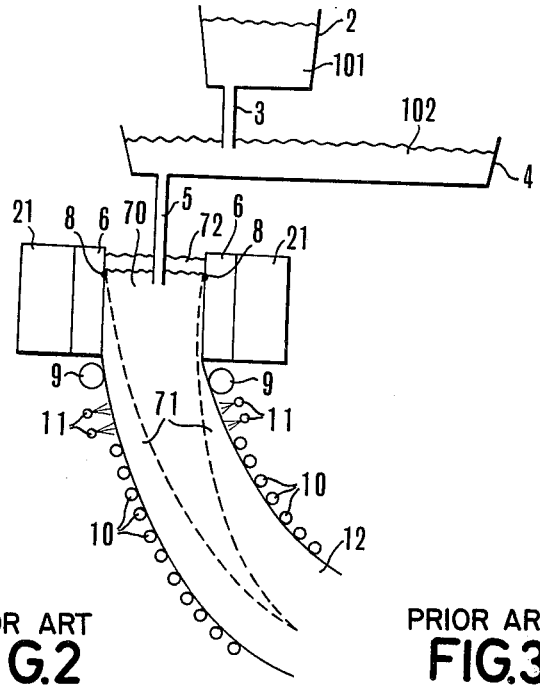
FIG.1 PRIOR ART
FIG. 1 is a schematic illustration of the conventional continuous steel casting system.
Figure 2:
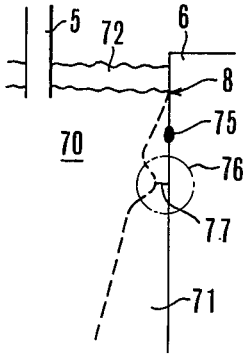
PRIOR ART FIG.2
FIG. 2 is a schematic illustration showing a seizure taking place due to heat at a point where molten steel begins to solidify and a crack resulting from the seizure.
Figure 3:
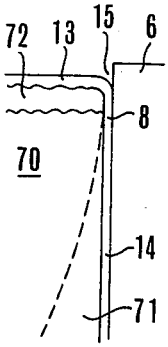
PRIOR ART FIG.3
FIG. 3 is a schematic illustration of a method for forming a seizure preventing matter between a solidifying steel layer and a mold.
Figure 4:
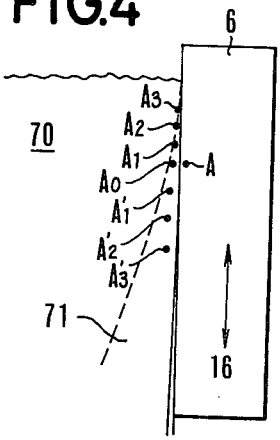
PRIOR ART FIG.4
FIG. 4 is a schematic illustration of the conventional method for vibrating the mold.
Figure 5:
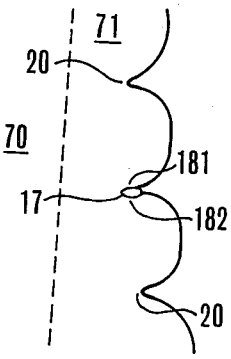
PRIOR ART FIG.5
FIG. 5 is an illustration of powder being trapped at an oscillation mark.
Figure 6A:
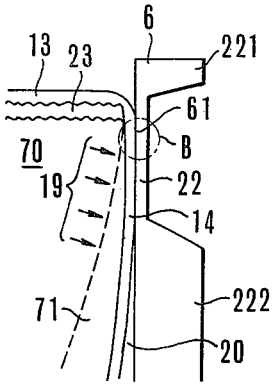
FIG. 6(*a*) is a schematic plan view showing an assembled type mold as an embodiment of the invention and as in a state of having its surface vibrated on the sides facing the metal being cast with high frequency oscillation applied thereto.
Figure 6B:
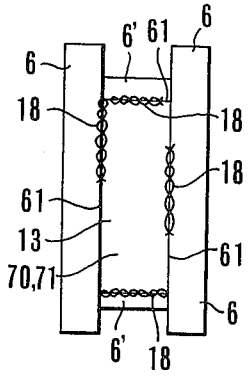
Figure 10A:
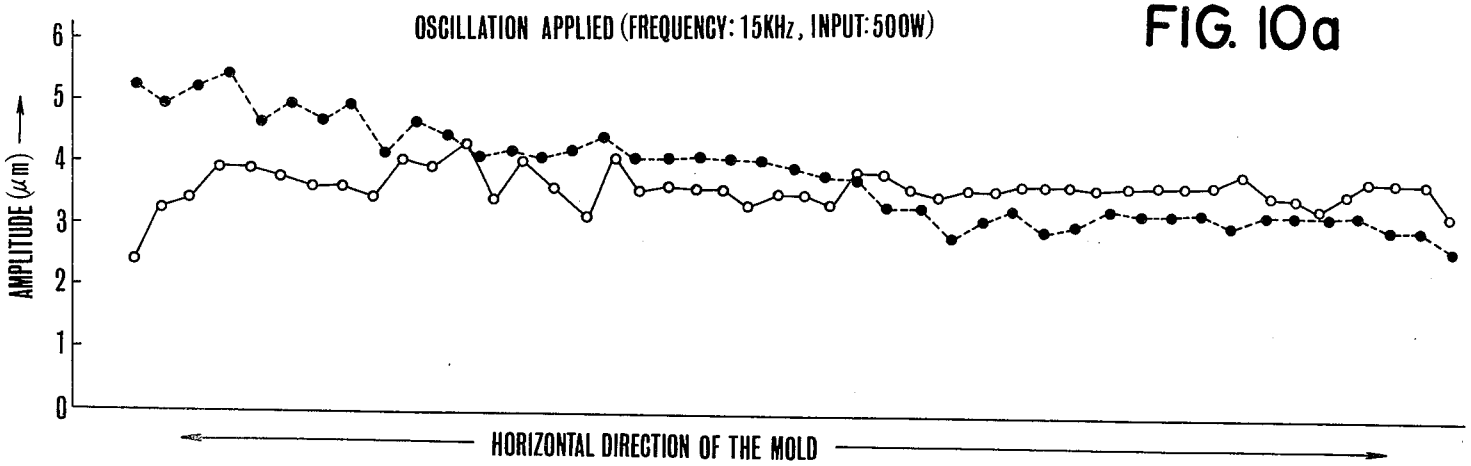
FIG. 10(*a*) is a graphic representation showing the relation of the horizontal position of the mold shown in FIG. 9 to the amplitude thereof when oscillation of frequency 15 KHz and input 500 W is applied.
Figure 10B:
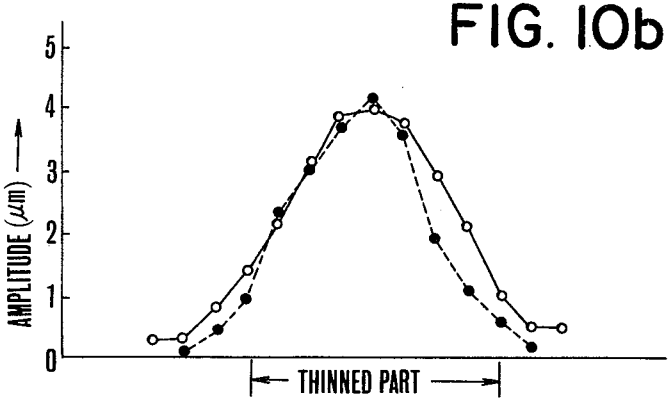

As is well known, it is difficult to have a heavy body stably vibrated at a high frequency. As shown in FIG. 1, the mold 6 to be used for continuous casting of steel is unified into one body with a cooling box 21 which is tightly connected to the rear of the mold with bolts. In addition to that, cooling water which is not shown flows through the inside of the cooling box 21. The weight of the mold assembly which is arranged in this manner reaches 15 to 20 tons. It is hardly possible to vibrate the mold at a high frequency under that condition. However, when the wall thickness of the mold 6 is thinned in part as shown in FIGS. 6(*a*) and 6(*b*) which indicates the thinned part by a reference numeral 22, the thinned part 22 can be vibrated by applying high frequency oscillation to the mold while other parts 221 and 222 of the mold little vibrate in response to the high frequency oscillation. In other words, as shown in FIG. 10(*b*), the impressed oscillation energy is confined to the thinned part 22 and is not transmitted to the thicker parts 221 and 222. It is thus only a part of the mold 6 that is vibrated at a high frequency.

Figure 8:
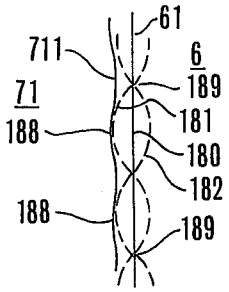
FIG. 8 is a schematic illustration showing vibration of the mold shown in FIGS. 6(*a*) and 6(*b*) with the high frequency oscillation applied thereto.

Therefore, as shown in FIG. 6(*b*), the part of the mold 6 confronting the molten steel 70, i.e. the part located in the vicinity of a point where the molten steel begins to solidify, is arranged to be thinner than other parts of the mold. A seizure preventing effect attainable with arrangement to have a high frequency oscillation 18 at the thinned part of the mold 6 in a direction perpendicular to the surface 61 of the mold is as follows: Referring now to FIG. 8 which is an enlarged view of the thinned part B indicated in FIG. 6(*b*), the inner wall face 61 of the mold 6 is at a neutral point 180 when the mold 6 is not vibrated. However, when the oscillation is applied to the mold 6, the inner wall face 61 repeats a reciprocating motion between positions 181 and 182. When the inner wall face 61 of the mold 6 moves from the position 182 to the other position 181 toward the solidifying layer 71 of the molten steel, the solidifying layer 71 which is in contact with the inner wall face 61 of the mold makes a contracting motion in the same direction as the inner face 61 of the mold 6. Conversely, when the inner face 61 of the mold 6 moves from the position 181 to the position 182 in the expanding direction, the heavy weight of the solidifying layer 71 does not allow it to follow the inner face 61. Accordingly, when the mold 6 vibrates at a high frequency, the solidifying layer 71 within the mold 6, does not make the same motion as the mold 6 but settles down into a shape 711 which is approximately along the position which the inner wall face 61 of the mold 6 takes when the vibrating motion thereof comes to the innermost point. As a result of this, the solidifying layer 71 is allowed to be in contact with the inner wall face 61 of the mold 6 only for a very brief period of time before and after the inner wall face 61 takes the position 181 at the maximum amplitude of the vibration thereof. With the exception of this period, the solidifying layer 71 stays away from the mold 6 during the most of the remaining period of time. This brief contacting period precludes the possibility of having the seizure 75 due to heat.

As mentioned in the foregoing, a surface crack tends to be induced by an oscillation mark. This is because the relative movement between the mold 6 and the solidifying layer 71 resulting from low frequency vertical vibration 16 of the mold 6 causes the powder 13 to unevenly remain in a partly concentrated state on the surface of the solidifying layer. The uneven partly concentrated state of the powder 13 results from that: The flow of the powder 13 down through the gap between the mold 6 and the molten steel 70 takes place in synchronism with the oscillating operation on the mold 6. Therefore, the low frequency vibration 16 of several times per second or thereabout inevitably causes the powder to be unevenly distributed over the surface of the cast steel piece 12.

Whereas, in accordance with the present invention, the mold is vibrated at a frequency by far higher than the above stated low frequency. Therefore, the flowing time of the powder is virtually uniformalized. Accordingly, the powder 13 is uniformly distributed over the surface of the cast piece 12 in the longitudinal direction thereof.

The location of the part in which the mold is arranged to be thin in accordance with the present invention is as follows: The effect of the high frequency oscillation appears in the prevention of the seizure 75 and a decreased number of surface cracking flaws of the cast steel piece. This effect of the high frequency oscillation varies with the location of the thinned part of the mold. Since the occurrences of the surface cracking flaws of the cast steel piece can be minimized by arranging the powder 13 to flow down uniformly into the gap 15 between the mold 6 and the molten steel 70, the vibration must be arranged to take place in the vicinity of the level of the molten bath surface.

Figure 7:
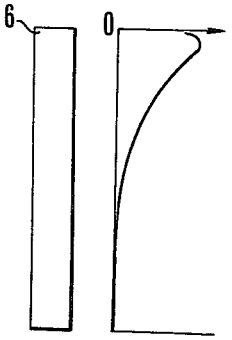
FIG. 7 is an illustration of a position-to-amplitude relation of a steel piece.

Further, since the seizure due to heat can be prevented with the period of time for which the solidifying layer 71 is in contact with the inner wall face 61 of the mold 6 shortened by high frequency oscillation, the greatest effect can be attained by applying the oscillation at a point where vibration most readily takes place within the solidifying layer 71. Meanwhile, as has been mentioned in the prior art statement, the solidifying layer 71 begins to be formed at a point 8 close to the level of the molten bath surface and the thickness of the solidifying layer increases and the temperature thereof decreases according as it descends further. Therefore, a higher part of the solidifying layer is more readily movable than a lower part thereof. When oscillation is applied under the same condition, the distribution of amplitude of the solidifying layer is as schematically shown in FIG. 7.

In accordance with the present invention, the high frequency oscillation is applied to the mold preferably in a direction perpendicular to the inner wall face of the mold, though it does not have to be perpendicular to the inner wall face.

The seizure preventing effect has been described in the foregoing as attainable with oscillation applied perpendicularly to the inner wall face 61 of the mold. In such a case, the vibration of the inner wall face 61 of the mold consists mostly of a component perpendicular to the inner wall face of the mold and very little components in other directions, if there are any. As apparent from the foregoing description, with the mold of the present invention employed, oscillation is applied thereto preferably in a direction other than the vertical direction. However, it is also effective to apply oscillation in the vertical direction as will be understood from the following description: To have the power 13 brought into the uneven partly concentrated state by the mechanism which has been mentioned in connection with the oscillation mark, a period of time of at least 0.1 second or thereabout is necessary. Whereas, in accordance with the present invention, the mold 6 is vibrated at a high frequency which exceeds this response speed. Therefore, even when the vibration takes place in the vertical direction, the solidifying layer 71 and the powder 13 are not allowed to have a sufficient period of time for displacement, so that the powder can be kept from having any locally concentrated part.

Further, it is preferable to have the high frequency oscillation on the mold 6 varied in a given cycle. If the oscillation exerted on the mold 6 from outside is in a stable state such as sinusoidal waves, the vibration that takes place at the inner wall face 61 of the mold 6 would come to be in a state of standing waves. In other words, when the inner wall face 61 happens to be a crest of the wave (a position 188 as shown in FIG. 8), a part of the solidifying layer 71 which comes in contact with the crest strongly receives the effect of the invention while another part of the solidifying layer 71 which comes in contact with the bottom of the wave (a position 189 as shown in FIG. 8) slightly receives the effect. The surface of the cast piece 12 thus has some parts strongly receive the effect of the invention while other parts weakly receive the effect. These strongly and weakly influenced parts appear in a vertical stripe like pattern at intervals of half wave-length of standing waves. This can be prevented either by continuously varying the frequency of the high frequency oscillation applied to the mold 6 within a given range or by varying, in a given cycle, a restricting condition imposed on the thinned part of the mold 6 in such a way as to change the locations of the crests and bottoms of the standing waves taking place on the inner wall face 61 of the mold.

Figure 9:
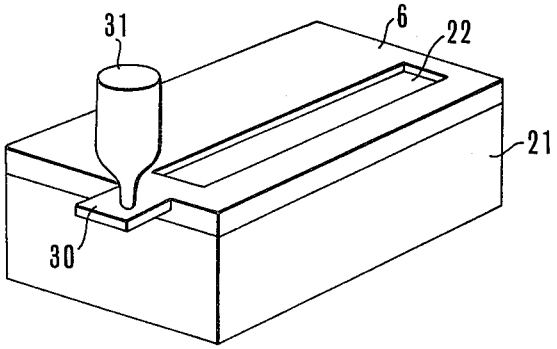
FIG. 9 is an illustration showing by way of example an arrangement wherein a vibration transmitting plate is formed with the bottom of a grooved part arranged to protrude and an oscillator is secured thereto.

With the wall thickness of the mold 6 decreased in part and with the high frequency oscillation applied to the thinned part in accordance with the present invention, the vibration of the mold is confined to the thinned part. This will be understood from the following description of an example: Referring now to FIG. 9, a copper mold 6 measuring 65 mm in thickness is used. A groove 22 is provided in an outer side of the mold 6 with the wall thickness at this groove 22 thinned to 20 mm. A cooling box 21 is connected to the mold with many bolts, which are not shown, tightened thereto at parts other than the grooved or thinned part. The thinned part is extended to the outside to form a vibration transmitting plate 30 which is arranged to be thinner than the thinned part. An oscillator 31 which is arranged to vertically oscillate is connected to the vibration transmitting plate 30. The oscillator 31 is caused to oscillate by a 500 W input of frequency 15 KHz. Then, the mold vibrates as shown in FIGS. 10(*a*) and (*b*), which show the amplitude of the vibration of the mold 6 in the direction of the groove and also in the direction perpendicular to the groove. As apparent from these illustrations, the grooved or thinned part vibrates to an amplitude of 3 to 5 μm, whereas the vibration decreases to an amplitude of less than 1 μm in other parts of the mold. This clearly indicates that the induced vibration is confined to the grooved part. It has been confirmed, through experiments, that results similar to this are obtainable within a range of input oscillation from 10 to 30 KHz.

Figure 11:
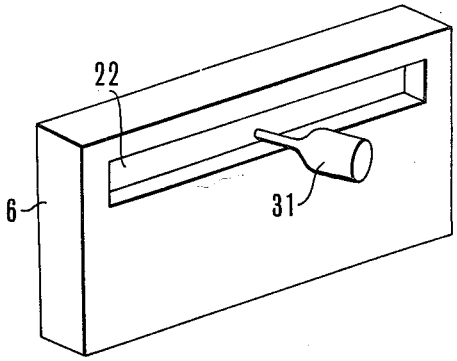
FIG. 11 is an illustration of an example in which an oscillator is secured directly to the bottom of a grooved part of the mold.
Figure 12A:
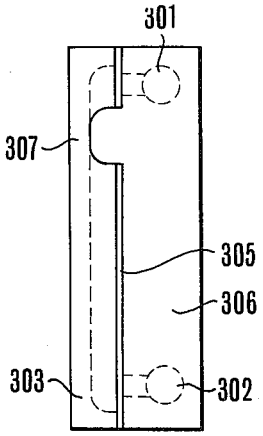
FIGS. 12(*a*), (*b*), (*c*), (*d*), (*e*) and (*f*) are schematic views showing an embodiment of the invention as applied to a curved type continuous casting system using an upward open, water cooled type copper mold.
Figure 12B:
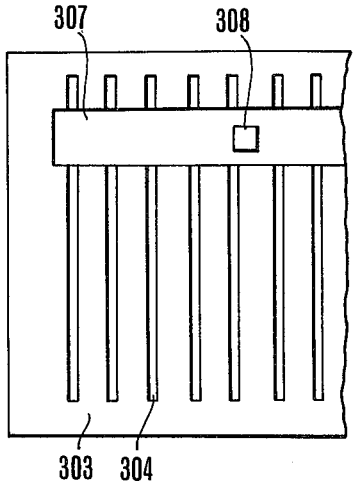
Figure 12C:
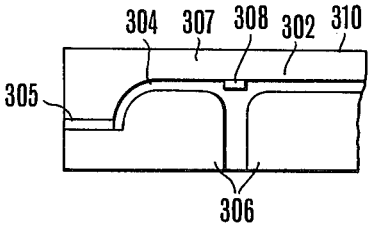
Figure 12D:
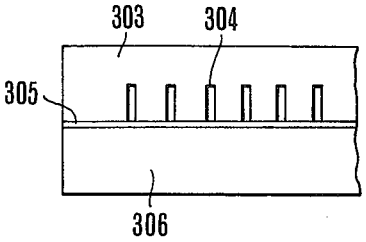
Figure 12E:
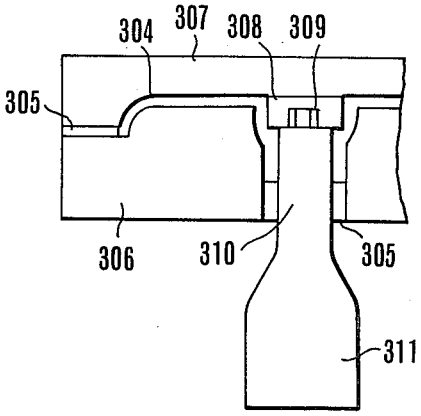
Figure 12F:
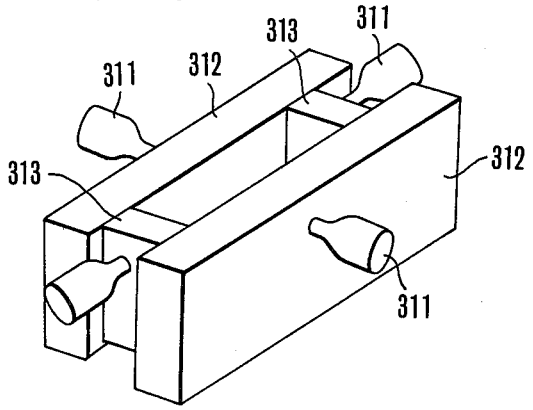

In accordance with the invention, the mold 6 can be vibrated through the grooved part thereof by various methods. In the case of the example given in the foregoing, the vibration is imparted through the vibration transmitting plate 30. In another method which is illustrated by FIG. 11, the same vibration can be obtained from the use of a direct input arrangement 32. In this case, a groove 22 measuring 25 mm in depth is formed in a mold 6 measuring 40 mm in thickness. An oscillator 31 is attached directly to the grooved part 22. With this arrangement, oscillation of frequency of 18 KHz is applied.

The thinned or grooved part of the mold arranged in accordance with this invention is preferably in the following shape and preferably disposed at the following location: The preferred thickness of the grooved part is 5 to 30 mm. As mentioned in the foregoing, good results are obtainable with the thickness of the grooved part set at a value between 15 mm and 20 mm. Thickness less than 5 mm is not practical, because: Heat transmission saliently varies with location; machining becomes very difficult; and service life becomes short because of less allowance for grinding. Conversely, thickness exceeding 30 mm has a less degree of amplitude and, as has been confirmed through tests, does not give a desired effect. In view of this, the thickness of the grooved part of the mold is preferably between 5 mm and 30 mm. Further, the grooved part may be provided with one or a plurality of reinforcing ribs arranged either in the direction of the groove or perpendicularly to the groove.

The groove is located preferably within 300 mm from the upper end of the mold. While, in the light of the principle, the groove should be formed in the horizontal direction, the preferred location of the groove is within 300 mm from the top of the mold, because: Considering it qualitatively, the maximum effect of vibration obtains in the vicinity of the solidification starting point 8. However, judging from the results of tests conducted to find the temperature distribution in the vertical directions of the mold, the solidification starting point 8 seems to be located 150 mm to 250 mm from the top of the mold. Meanwhile, the position of the molten bath surface is controllable to an extent within a range of ±10 mm. Therefore, making allowances, it is believed that the suitable location of the groove is within 300 mm from the top of the mold. Further, the groove is formed either in each of the longer sides of the mold only or in both the longer and shorter sides of the mold.

The width of the groove is preferably 50 mm to 150 mm. Tests were conducted using two different molds made of copper both measuring 32 mm in thickness. One mold was provided with a groove measuring 100 mm in width while the other had a groove measuring 80 mm in width. Using the oscillator-and-vibration transmitting plate type input arrangement, oscillation of 18 KHz, 150 W, was applied to these molds. Both of them showed amplitude of 15 μm to 20 μm thus showing no significant difference between them. However, in cases where the width of the groove is less than 50 mm, there is the possibility that the groove comes outside of the range of variation of the molten bath level. On the other hand, where the width of the groove is exceeding 150 mm, the vibration energy is dispersed too much to obtain a sufficient effect of vibration.

As for the frequency of the vibration, there is no particular upper limit to the frequency. However, with the frequency arranged to be higher than 30 KHz, the present oscillator manufacturing technique does not allow to obtain a sufficient degree of amplitude for a practical application. On the other hand, frequency below 10 KHz would produce some noise that has an adverse effect on workers. An operation with frequency less than 10 KHz is, therefore, not desirable.

The features and advantages of the invention will further become apparent from the following description of an example of embodiment of the invention.

FIGS. 12(*a*), (*b*), (*c*), (*d*), (*e*) and (*f*) illustrate a mold prepared in accordance with the invention for use in a curved type continuous casting system arranged to use an upward open, water cooled type copper mold. As shown in FIG. 12(*f*), the invented mold is of a four side assembled type consisting of a pair of confronting longer side walls 312 and a pair of confronting shorter side walls 313. The mold is made of a copper plate 303 measuring 60 mm×80 mm and a reinforcing steel plate 306. In the interior of the mold, there are provided cooling water channels 304, each forming a cooling water inlet 301 at one end and a cooling water outlet at the other thereof. There is provided a thinned part 307 at a location 100 mm below the upper end of the copper plates 303, the thinned part 307 measuring 120 mm in width in the vertical direction. An oscillator 311 is secured to the thinned part 307 through a base plate 308 with a connecting screw 309. A packing 305 is placed between the copper plate 303 and the reinforcing plate 306 and between the oscillator 311 and the wall of a hole provided in the reinforcing plate. Table 1 compares the mold with the conventional mold.

TABLE 1

| Structural Arrangement and Dimensions of Mold | Conventional Mold | Invented Mold |
|---|---|---|
| The type of mold: | four side assembled type | four side assembled type |
| 1. Shape of longer side of mold: | | |
| Length | 1900 mm | 1900 mm |
| Height | 800 mm | 800 mm |
| Thickness of cooling copper plate | 60 mm | 60 mm |
| Thickness of thinned part | — | 15 mm |
| Width of thinned part | — | 120 mm |
| Length of thinned part | — | 1700 mm |
| Cooling water channel | Copper plate grooved, groove measuring 5 × 45 mm | Thinned part without slit, water channel 2 mm |
| 2. Shape of shorter side mold: | | |
| Length | 250 mm | 250 mm |
| Height | 800 mm | 800 mm |
| Thickness of cooling copper plate | 60 mm | 60 mm |
| Thickness of thinned part | — | 15 mm |
| Width of thinned part | — | 120 mm |
| Length of thinned part | — | 190 mm |
| Cooling water channel | Same as longer side | Same as longer side |
| 3. Oscillation rod connection: | Screwed to copper plate | Secured to thinned part through base plate |

Experiments were conducted using the above stated molds. In each of the experiments, the molten bath surface was arranged to be always 150 mm below the upper end of the mold. Casting was carried out with high frequency oscillation applied under the input conditions as shown in Table 2. The surface condition of each slab thus obtained was examined in terms of the rate of area required surface grinding. The results of this were as shown also in Table 2.

TABLE 2

| Percentage of Slabs Required Surface Grinding | | |
|---|---|---|
| Surface Quality Index* | Conventional Method | Invented Method |
| 1 | 90% | 100% |
| 2 | 8 | 0 |
| 3 | 2 | 0 |
| High frequency input condition, frequency 18 KHz | | |
| Longer side: 1.9 KW/side × 2 sides | | |
| Shorter side: 0.5 KW/side × 2 sides | | |

*Notes:
Index 1: Rate of area required surface grinding less than 1%
2: Rate of area required surface grinding 1–5%
3: Rate of area required surface grinding more than 5%

Figure 13:
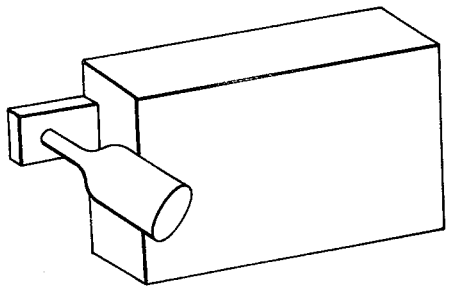
PRIOR ART FIG.13
FIG. 13 is schematic view showing a longer side of the conventional mold arrangement for comparison with the invented mold arrangement.
Figure 14:
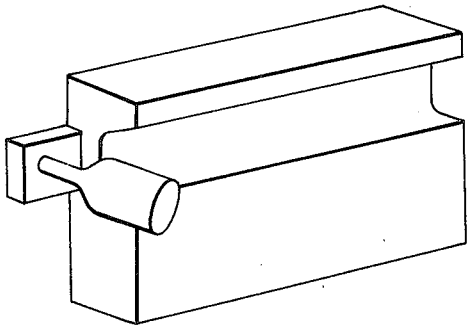
FIG. 14 is a schematic view showing a longer side of the invented mold.
Figure 15:
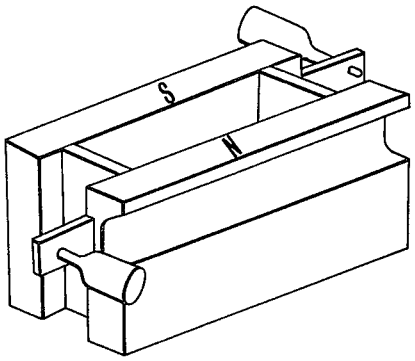
FIG. 15 is a schematic view showing a test arrangement including the invented mold and the conventional mold for comparison.
Figure 16:
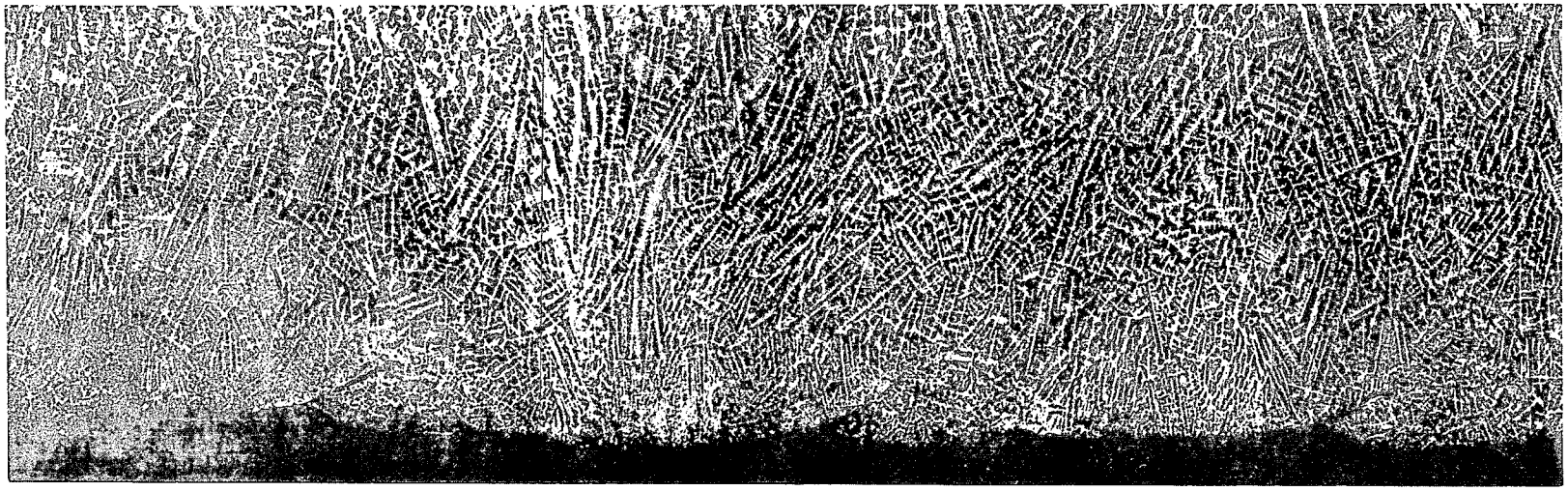
FIG.16 PRIOR ART
FIG. 16 is a photograph showing the oscillation marks.

For further confirmation of the effect of the present invention, a longer side of the mold of the present invention as shown in FIG. 14 was prepared, and a longer side of the conventional mold was also prepared as shown in FIG. 13 for comparison. They are arranged into an assembly as shown in FIG. 15. Then, oscillation was applied to the vibration transmitting plate of each of them at frequency 15 KHz, input 500 W, to obtain a steel slab measuring 200 mm × 1980 mm. The oscillation is applied only to the longer sides and not to the shorter sides of the assembly. With the exception of the shape of the mold, casting was carried out under the same conditions as those of the conventional casting operation.

Table 3 shows the surface condition of the cast piece thus obtained and the mold surface amplitude, at a point corresponding to the solidification starting point of the molten steel, of the invented mold, which is represented by a side N as shown in FIG. 15, in comparison with those of the conventional mold, which is represented by a side S as shown in FIG. 15.

TABLE 3

| Mold | Side | Amplitude (Range of peak values) | Rate of surface flaw occurrence (Rate of area requiring surface grinding) % |
|---|---|---|---|
| Invented Mold | N | 3–5 μm | 0.3 |
| Conventional Mold | S | Not detectable | 5.1 |

As apparent from the results of the above-mentioned experiments, the steel slab obtained from the use of the invented mold has excellent surface quality.

What is claimed is:

1. A method for continuously casting molten steel with the use of a mold of the type having a horizontally disposed, open top portion, elongated side walls extending generally vertically from said top portion, said side walls having each an exterior surface and at least one of said side walls having a horizontally extending groove formed therein having a vertical width within the range of 50–150 mm being located within approximately 300 mm from said top portion, the steps comprising:

applying an oscillation of between 10 KHz to 30 KHz to said groove so as to vibrate said mold at the location of said groove while molten steel is being continuously cast into said mold and with the direction of vibration being generally perpendicular to the direction of flow of the molten steel.

2. A mold suitable for continuous casting of molten metal comprising in combination a wall member which has locally thinned parts extending in a horizontal direction and located at the portion of the mold which is at the starting point of solidification of said molten metal when the molten metal is in said mold and means for applying high frequency oscillation to said locally thinned parts, the thickness of said locally thinned parts being between 5 to 30 mm in thickness; each of said thinned parts having a vertical width of between 50–150 mm; said means for applying oscillation to said locally thinned parts being secured directly to each of said thinned parts; each of said thinned parts being located within 300 mm from the upper end of said mold.

* * * * *

UNITED STATES PATENT AND TRADEMARK OFFICE

CERTIFICATE OF CORRECTION

PATENT NO. : 4,460,034

DATED : July 17, 1984

INVENTOR(S) : Tsuyoshi Saeki et al.

It is certified that error appears in the above-identified patent and that said Letters Patent is hereby corrected as shown below:

On the title page insert:

-- /73/ Assignee: Nippon Steel Corporation, Tokyo, Japan --.

Signed and Sealed this

Twelfth Day of February 1985

[SEAL]

*Attest:*

DONALD J. QUIGG

*Attesting Officer* *Acting Commissioner of Patents and Trademarks*